United States Patent [19]

Ahlgren

[11] 4,126,407

[45] Nov. 21, 1978

[54] METHODS OF SHIFTING HEAVY AND/OR LOADED STRUCTURES

[76] Inventor: Nils H. Ahlgren, 22 Skyttevägen, S-133 00 Saltsjobaden, Sweden

[21] Appl. No.: 815,988

[22] Filed: Jul. 5, 1977

Related U.S. Application Data

[60] Division of Ser. No. 594,516, Jul. 9, 1975, Pat. No. 4,050,225, which is a continuation-in-part of Ser. No. 478,592, Dec. 6, 1974, abandoned.

[51] Int. Cl.[2] ..... F21D 11/10

[52] U.S. Cl. ..... 425/63; 249/10

[58] Field of Search ..... 425/63, 65; 249/10

[56] References Cited

U.S. PATENT DOCUMENTS

| | | | |
|---|---|---|---|
| 1,649,674 | 11/1927 | Egan | 425/65 |
| 2,045,789 | 6/1936 | McDowell | 425/65 |
| 2,596,854 | 5/1952 | Jack et al. | 425/65 |
| 2,617,168 | 11/1952 | Johnson | 425/63 X |
| 2,620,543 | 12/1952 | Scharsach | 425/65 |
| 2,870,518 | 1/1959 | Bossner | 425/63 |
| 3,593,392 | 7/1971 | Lambertini | 425/63 |
| 3,663,132 | 5/1972 | Andersson | 425/65 |
| 3,973,885 | 8/1976 | Schmidt | 425/65 |

FOREIGN PATENT DOCUMENTS

| | | | |
|---|---|---|---|
| 902,188 | 1/1954 | Fed. Rep. of Germany | 249/10 |
| 2,258,542 | 6/1973 | Fed. Rep. of Germany | 425/63 |
| 1,004,045 | 11/1951 | France | 425/63 |
| 1,162,982 | 4/1958 | France | 249/10 |

*Primary Examiner*—J. Howard Flint, Jr.
*Attorney, Agent, or Firm*—Rose & Edell

[57] ABSTRACT

Apparatus for sifting heavy supporting structures relative to stationary load carrying structures comprises a plurality of parallel jack rods secured to the load carrying structure. A plurality of climbing jacks adapted to operatively engage the jack rods are secured to the heavy supporting structure. The arrangement is such that the heavy supporting structure is shifted relative to the load carrying structure when the climbing jacks are operated and advance along the jack rods while the load carrying structure remains stationary. The reactive forces caused by the operation of the climbing jacks is transferred to the load carrying structure by the jack rods. A method for shifting heavy supporting structures is also disclosed.

9 Claims, 5 Drawing Figures

FIG. 1
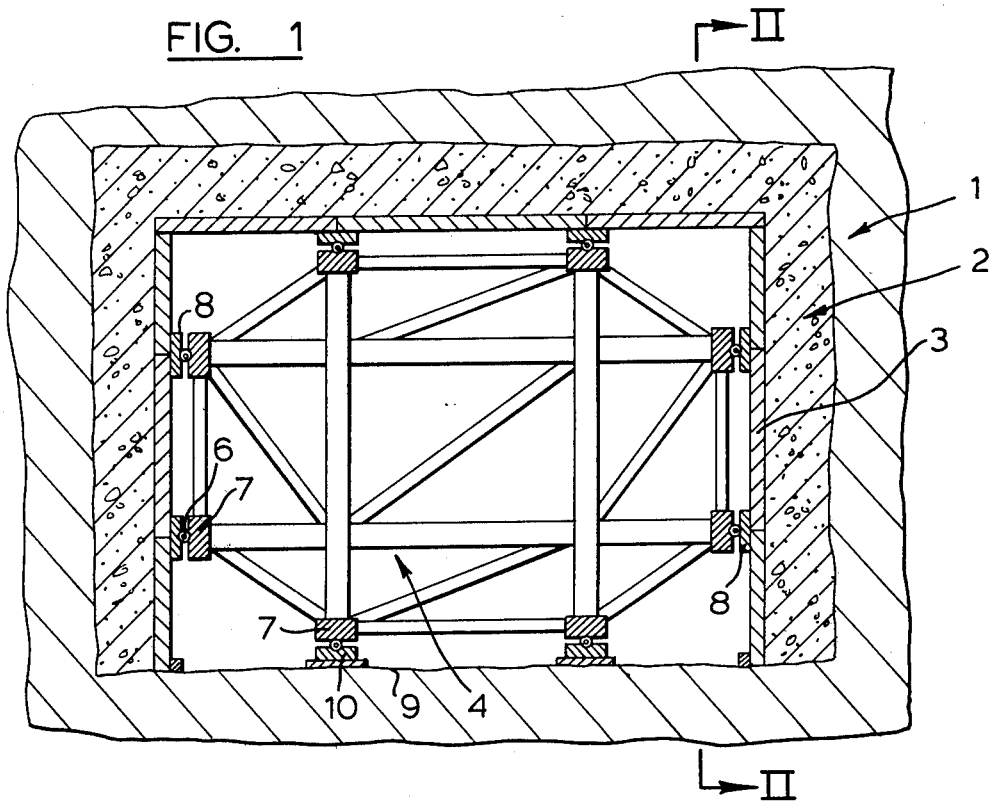
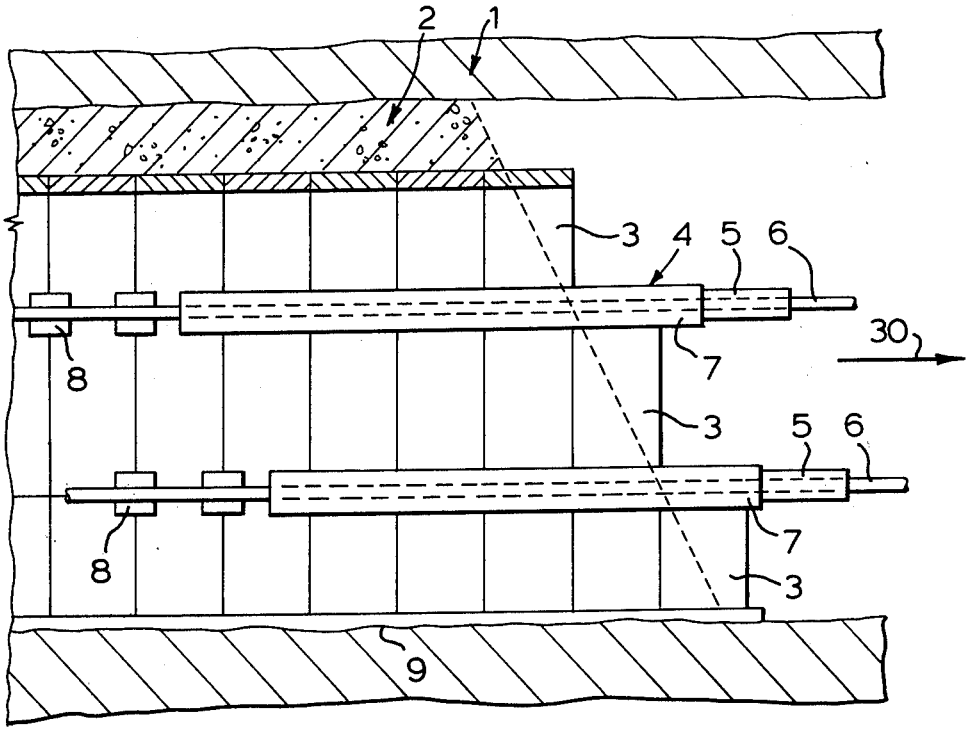
FIG. 2

FIG. 3
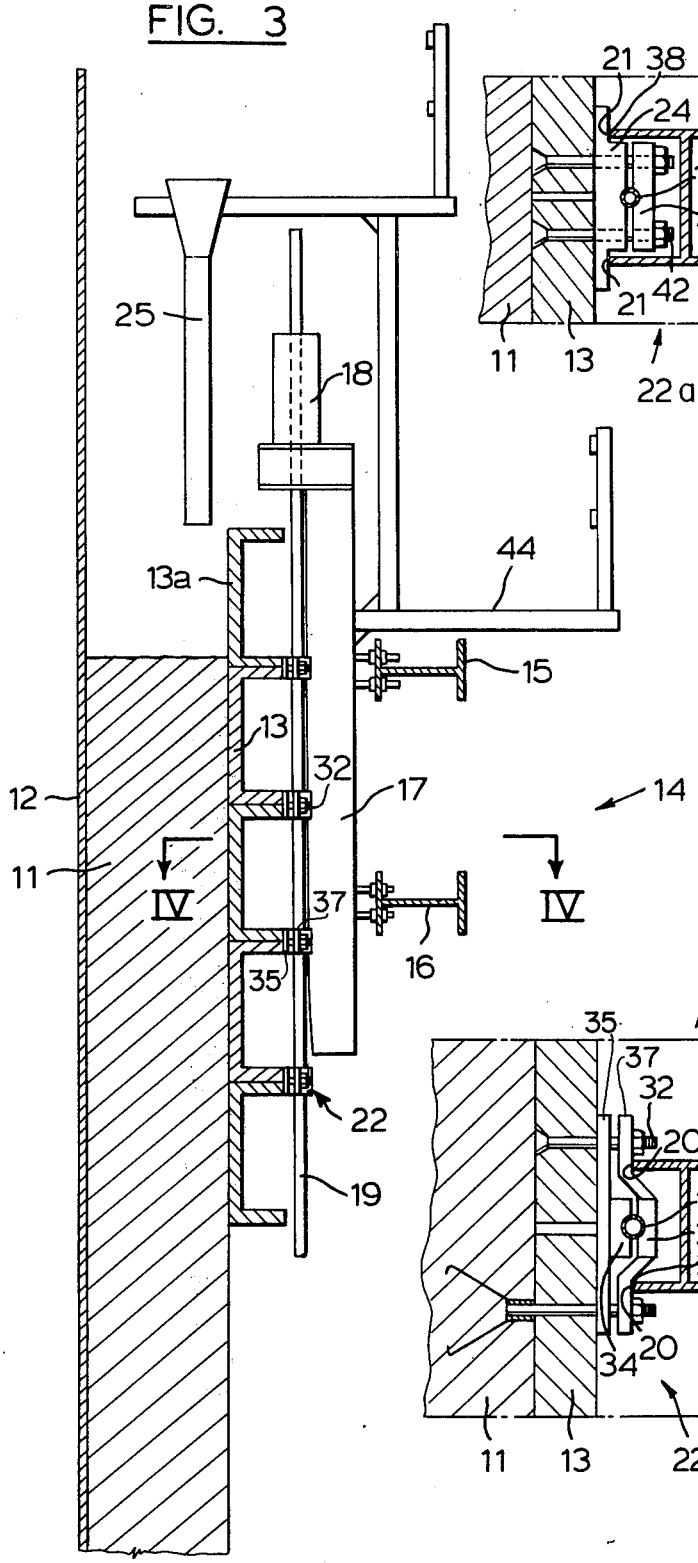
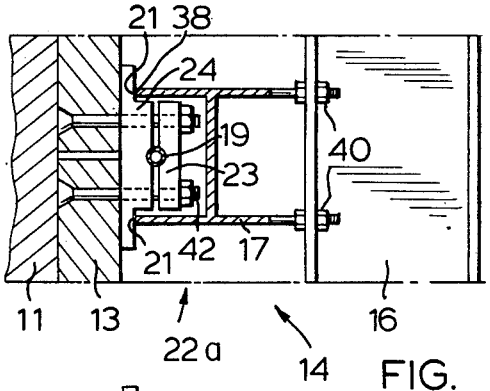
FIG. 5
FIG. 4
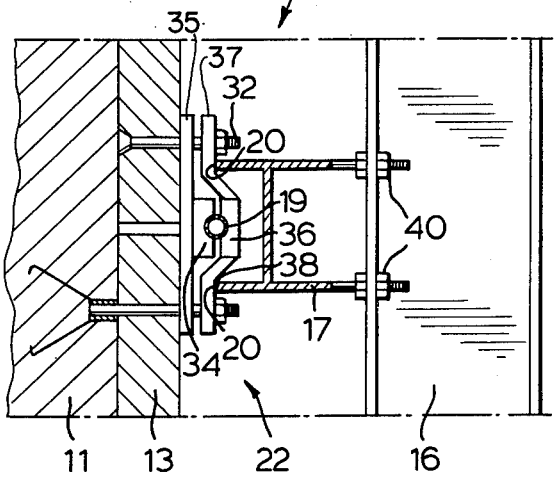

METHODS OF SHIFTING HEAVY AND/OR LOADED STRUCTURES

This is a division of application Ser. No. 594,516 filed July 9, 1975, (now U.S. Pat. No. 4,050,255 issued Sept. 27, 1977); which application 594,516 was continuation-in-part of U.S. patent application Ser. No. 478,592 filed Dec. 6, 1974 and which is now abandoned.

FIELD OF INVENTION

This invention relates to apparatus for shifting heavy supporting structures relative to stationary load carrying structures by means of climbing jacks which engage jack rods secured to the load carrying structure.

BACKGROUND OF THE INVENTION

Load carrying structures i.e. shuttering or formwork are commonly used in concrete forming, in building vertical walls, in lining tunnels with concrete, shoring freshly dug tunnel walls, and the like. With most concrete form work, shuttering in the nature of slip forms are used which are moved along the surface of set concrete. With this type of concrete form work, a supporting structure for the form work is secured to the form work and jacks move the supporting structure in order to advance the form work along the concrete face.

Climbing slip forms are well-known, such as that disclosed in Scharsach, U.S. Pat. No. 2,620,543. He dicloses concrete panel forms shuttering which are supported by a supporting structure which includes a number of vertical posts attached to the concrete panel forms. Guide rods are secured to the set concrete where the concrete form panels move independently of the guide rods. Jack rods are secured to the guide rods. Jacks are mounted on the supporting posts which engage the jack rods. Operation of the jacks advances the supporting structure. The concrete form panels are advanced simultaneously with advancement of the supporting structure because the concrete form panels are secured to the supporting structure. Like all other slip form concreting apparatus, Scharsach has no provision for permitting the concrete forming panels to remain stationary while the heavy supporting structure for the concrete panels is advanced by the operation of jacks.

In concrete forming and other operations such as lining horizontal tunnels, it is advantageous to have the shuttering or load carrying panels remain stationary while the supporting structure is advanced and additional load carrying panels attached to and in front of the stationary panels. For example, when concrete form panels are left stationary and new panels attached, the rate of concrete pouring can be varied within broad limits so as to be adapted to other working tasks associated with the concrete pouring operation. In some cases the use of climbing slip forms requires anchoring bolts in the concrete so that the slip forms are not advanced until the concrete has set. Stationary load carrying panels are advantageous for lining horizontal tunnels because the panels remain in position until the concrete has set or the walls of the tunnel are properly shored. Meanwhile, the heavy supporting structure can be advanced with additional panels placed in position, without waiting for the concrete to set so that the same panels may be advanced.

It is therefore an object of this invention to provide apparatus for shifting a heavy supporting structure relative to a load carrying structure which remains stationary.

It is a further object of the invention to provide in combination, a heavy supporting structure for a load carrying structure where the heavy supporting structure is advanced relative to the load carrying structure by use of jacks engaging jack rods which are secured to the load carrying structure generally a plurality of shuttering panels.

It is another object of the invention to provide a apparatus for placing concrete where the load carrying panels remain stationary during advancement of the concrete pouring operation.

It is yet another object of the invention to provide apparatus for lining tunnels with concrete and to provide apparatus for shoring tunnels to guard against landslide.

BRIEF SUMMARY OF THE INVENTION

The method apparatus provided according to this invention includes for heavy supporting structure and the load carrying structure, which remains stationary, and a plurality of climbing jacks which are adapted to engage a plurality of jack rods secured to the load carrying structure. Thus, as the climbing jacks move along the jack rods, the heavy supporting structure maybe shifted relative to the load carrying structure which remains stationary. The reactive force caused by operation of the climbing jacks is transferred to the load carrying structure by the jack rods. The heavy supporting structure supports the load carrying structure in a manner such that the heavy supporting structure is moveable relative to the load carrying structure. The plurality of climbing jacks are secured to the heavy supporting structure.

As the heavy supporting structure is advanced by operating the climbing jacks, additional load carrying structures may be placed in position and supported by the heavy supporting structure.

Thus apparatus according to this invention comprises, in combination, a shiftable heavy supporting structure which supports a stationary load carrying structure, and a plurality of parallel jack rods secured to the load carrying structure. A plurality of climbing jacks are provided, which are adapted to operatively engage the jack rods and are secured to the heavy supporting structure. The heavy supporting structure supports the load carrying structure in a manner such that the heavy supporting structure is moveable relative to the load carrying structure. The arrangement is such that the heavy supporting structure is shifted relative to the load carrying structure when the plurality of climbing jacks are operated and advanced along the jack rods while the load carrying structure remains stationary. The jack rods may be made up of a plurality of detachable portions which, when no longer under load, may be detached from the panels and placed ahead of the climbing jacks to permit continued advancement of the heavy supporting structure. The load carrying structure may be made up of a plurality of detachable load carrying panels. As the heavy supporting structure is advanced, additional load carrying panels may be secured to the most forward load carrying panel.

The apparatus according to this invention allows the load carrying structure to remain stationary as long as desired because the load carrying structure is not moved with advancement of the supporting structure. In addition, because the supporting structure moves independently of the load carrying structure, less jacking force is required to move the heavy supporting structure since there are no frictional forces to overcome between the load carrying structure and the material supported by the load carrying structure.

The apparatus according to this invention is also applicable for use in tunnels to guard against landslides. The heavy supporting structure can also be used to support fillings, frames or the like in tunnel construction.

Unlike the apparatus of Scharsach, U.S. Pat. No. 2,620,543, the apparatus according to this invention permits the shifting of the heavy supporting structure while the load carrying panels remain stationary, by the operation of jacks secured to the heavy supporting structure operatively engaging jack rods secured to the load carrying panels.

DESCRIPTION OF THE DRAWINGS

These and other objects, advantages and features of the invention will become apparent in the following detailed description of the preferred embodiments of the invention as shown in the drawings wherein:

FIG. 1 is a cross section of a horizontal tunnel which is being lined with concrete.

FIG. 2 is a longitudinal section of the tunnel of FIG. 1 along the line 2—2.

FIG. 3 is a cross section of a vertical concrete wall which is being formed using apparatus according to this invention.

FIG. 4 is an enlarged section along the line 4—4 of FIG. 3.

FIG. 5 shows an alternate construction for the apparatus shown in FIG. 4.

DETAILED DESCRIPTION OF THE PREFERRED EMBODIMENTS

Referring to FIG. 1, the tunnel proper is designated 1. The tunnel is lined with concrete 2 where the bottom 9 of the tunnel is left unfinished. In the concrete lining operation stationary load carrying panels 3 are supported by a heavy supporting scaffolding structure 4. The scaffolding structure is erected in the interior of the tunnel 1 and supports the panels 3 in position as the tunnel is lined with concrete 2. The heavy supporting structure 4 is shiftable relative to the stationary panels 3. As shown in FIG. 2, hydraulic jacks 5 are secured to beams 7 of the heavy supporting structure 4. The hydraulic jacks 5 are adapted to operatively engage jack rods 6. Although not shown, the jack rods 6 are secured relative to the panels 3 so that the jack rods remain stationary relative to them. The jack rods 6 are spaced from the panels 3 by pads 8.

In order to shift the heavy supporting structure 4 relative to the load carrying panels 3, the jacks 5 are operated so as to cause the jacks 5 to move along jack rods 6 in the direction of arrow 30. During such movement of the supporting structure 4, the panels 3 remain stationary.

The beams 7 of the supporting structure 4 support the load carrying panels 3 through jack rods 6 as they rest against pads 8. The beams 7 slide along jack rods 6 when the hydraulic jacks 5 are operated. The reactive forces caused by the jacks 5 are directly transferred to the jack rods. The shifting of the stationary load carrying panels 3 is prevented by the jack rods being secured relative thereto. The jacks 5 may be adapted to push or pull the structure 4 in either direction within the tunnel.

The beams 7 are of substantial length so as to keep the jack rods 6 in position and prevent outward buckling of the jack rods 6 when under load. The beams 7 may be located obliquely of one another as shown in FIG. 2 so that the pouring of the concrete can take place with the oblique casting front as shown in FIG. 2. The load carrying panels 3 are mounted and dismounted if desired in a manner substantially parallel with the casting. As the heavy supporting structure 4 is moved through the tunnel, additional load carrying panels 3 may be attached to the foremost load carrying panels to provide a load carrying structure for freshly poured concrete.

The bottom of the tunnel 9 is left open. Jack rods 6 rest on plates 10 mounted on the tunnel bottom 9. All of the jack rods 6 are located substantially parallel to one another.

In another embodiment of the invention the jack rods 6 may rest on hydraulic jacks or resilient devices which are placed on bottom 9 whereby the load carried by the beam 7 is more uniformly distributed over the jack rods 6. The number of jack rods 6 on which the heavy supporting structure 4 slides is selected with regard to the weight and/or load of the supporting structure 4 and with regard to the inclination of the tunnel bottom 9. In some cases the number of jack rods 6 may be so large that they form a mat along the walls of the tunnel.

The tunnel shown in FIGS. 1 and 2 may merge into a substantially vertical shaft where all walls of the shaft would be lined with concrete. In this instance, panels 3 would be provided on all four walls of the shaft to support the poured concrete.

FIG. 3 shows the concrete forming of a vertical wall of poured concrete 11. The concrete is poured between a sheet metal shell 12 and load carrying panels 13.

A heavy supporting structure 14 supports a load carrying panel 13 against the outward pressure of the poured concrete. The heavy supporting structure 14 includes a number of bracing units 15 and 16. If the concrete wall 11 is for a nuclear reactor, which wall is usually circular, the bracing beams 15 and 16 are formed as continuous annular elements which are round or in the form of a polygon. In the casting of straight concrete walls 11, use is made of straight bracing elements 15 and 16 which at their ends engage guides or like means. Bracing beams 15 and 16 are required with such concrete pouring where the sheet metal wall 12 is not capable of supporting conventional form ties.

Spaced apart vertical beams 17 are braced by bracing beams 15 and 16. Jacks 18 are secured to vertical beams 17.

Jacks 18 are adapted to operationally engage vertical jack rods 19. The jack rods 19 are secured to load carrying panels 13 by clamp means 22. Jack 18 is located above load carrying panels 13 so that operation of climbing jacks 18 does not interfere with the load carrying panels.

Clamps 22 as shown in FIG. 4 secure the jacking rods 19 to the panels 13. Bolts 32 clamp jack rod 19 between plates 34 and 36, secured to plates 35 and 37 respectively, to firmly grasp the jacking rod 19. The outer plate 36 has planar surfaces 20 which are contacted by the edges 38 of vertical beams 17. The edges 38 slide along flat surfaces 20 during movement of heavy supporting structure 14. Bracing beams 16 are secured to vertical beams 17 by nuts 40.

In accordance with the present invention, the climbing jacks 18 are operated, so that the heavy supporting structure 14 is shifted in an upwards direction. The reactive forces caused by the operation of climbing jacks 18 are transferred to the stationary panels 13 which do not move during shifting of the heavy supporting structure 14.

It is understood that rollers and the like may be provided at ends 38 of vertical beams 17 to facilitate sliding of the beams 17 over clamps 22.

As the heavy supporting structure 14 is advanced, additional load carrying panels may be placed on top of the most forward load carrying panel 13*a*. The panels are detachably secured to one another. The jacking rods 19 may be made up of several detachable portions. As the heavy supporting structure is advanced, the lower end portion of the jack rod 19 may be detached and connected to the jack rod in front of the climbing jack 18 to permit continued advancement of the climbing jacks. However, during advancement of the heavy supporting structure, the load carrying panels 13 remain in position until removed.

An alternative arrangement having clamp means 22*a* is shown in FIG. 5. The jack rod 19 is clamped between members 23 and 24 which are secured to panel 13 by bolts 42. Surfaces 21 are provided on clamp member 24 on which the ends 38 of beams 17 slide during advancement of climbing jacks 18.

The jack rods 19 are fixed in their positions by clamp means 22 or 22*a* which are spaced apart a minimum distance to prevent buckling of the jack rods. As the jack rods 19 are relieved of stresses at the lower ends, they can be detached. The jack rods 19 transfer the reactive forces caused by the climbing jacks 18 to the load carrying panels 13.

A concrete supply hopper 25 is secured to the superstructure of the heavy supporting structure 14. In addition, scaffolding 44 may be provided on the superstructure for the operators.

While various preferred embodiments of the invention have been described herein in detail, it will be understood by those skilled in the art that variations may be made thereto without departing from the spirit of the invention or the scope of the appended claims.

I claim:

1. In combination, apparatus for shifting a heavy supporting structure relative to a load carrying structure which remains stationary relative to shifting movements of said heavy supporting structure, comprising: a heavy supporting structure and a load carrying structure, a plurality of parallel jack rods detachably secured to said load carrying structure so as to preclude relative motion of said jack rods with respect thereto; a plurality of climbing jack means adapted to operatively engage said plurality of jack rods so as to cause relative motion of said jack means with respect to said jack rods, said climbing jack means being secured to said heavy supporting structure; said heavy supporting structure supporting said load carrying structure in a manner such that said heavy supporting structure is slidable relative to said load carrying structure; so that said heavy supporting structure may be slidably shifted relative to said load carrying structure when said plurality of climbing jack means are simultaneously operated and advanced along said jack rods, and said load carrying structure remains stationary relative to said shifting movement of said heavy supporting structure; and so that the reactive forces in said jack rods which are caused by the operation of said climbing jack means are transferred to said load carrying structure by said jack rods.

2. The combination of claim 1, where said jack rods comprise a plurality of detachable portions.

3. The combination of claim 2, where said climbing jack means are placed so as to engage said jack rods ahead of where said jack rods are detachably secured to said load carrying structure.

4. The combination of claim 1, where said load carrying structure comprises a plurality of detachable load carrying panels which are adapted to be secured to adjacent load carrying panels.

5. The combination of claim 1, where said heavy supporting structure includes a plurality of beams, each being placed along a length of a corresponding jack rod, the length of each beam being sufficient to preclude bending of the corresponding jack rod when said reactive force is applied thereto.

6. The combination of claim 5, where said plurality of beams are each adapted to slide along the respective jack rod.

7. The combination of claim 1, where said heavy supporting structure is a bracing and scaffolding structure, and said load carrying structure is a concrete forming structure.

8. The combination of claim 1, where said load carrying structure comprises a plurality of concrete forming panels, and said heavy supporting structure is arranged with said concrete forming panels for sliding motion with respect thereto in a substantially horizontal direction.

9. The combination of claim 1, where said load carrying structure comprises a plurality of concrete forming panels, and said heavy supporting structure is arranged with said concrete forming panels for sliding motion with respect thereto in a substantially vertical direction.

* * * * *